United States Patent [19]

Strassmeir

[11] Patent Number: 4,603,565

[45] Date of Patent: Aug. 5, 1986

[54] CYLINDER LOCK EMBODYING AT LEAST TWO ROWS OF TUMBLER PIN BORES AND OPPOSED ROWS OF LOCKING PINS WHICH INTERACT TO PRECLUDE PICKING

[76] Inventor: Maximilian E. F. Strassmeir, 25 Lehmann Avenue, Liverpool, New South Wales, Australia, 2170

[21] Appl. No.: 552,505

[22] Filed: Nov. 17, 1983

[30] Foreign Application Priority Data

Nov. 23, 1982 [AU] Australia ..... PF6936

[51] Int. Cl.[4] ..... E05B 27/06

[52] U.S. Cl. ..... 70/358; 70/364 A; 70/401; 70/409

[58] Field of Search ..... 70/364 A, 358, 401, 70/409, 419

[56] References Cited

U.S. PATENT DOCUMENTS

| | | | |
|---|---|---|---|
| 1,905,177 | 4/1933 | Kirkwood | 70/401 |
| 1,965,889 | 7/1934 | FitzGerald | 70/419 |
| 2,070,233 | 2/1937 | Liss | 70/419 |
| 2,620,649 | 12/1952 | Bernardo | 70/401 |
| 3,455,130 | 7/1969 | Basseches | 70/364 A |
| 4,393,673 | 7/1983 | Wider | 70/358 |
| 4,478,061 | 10/1984 | Preddey | 70/358 |

*Primary Examiner*—Robert L. Wolfe

*Attorney, Agent, or Firm*—Lackenbach Siegel Marzullo Presta & Aronson

[57] ABSTRACT

A cylinder lock assembly which includes a hollow lock body and a barrel rotatably mounted in the lock body having a keyway extending longitudinally from one end thereof.

There is also provided a plurality of tumbler pin bores located in the barrel arranged in one or more rows. Each tumbler pin bore communicates with the keyway.

There is also provided a plurality of tumbler pins provided in one or more rows wherein each tumbler pin is located in an associated tumbler pin bore.

There is also provided a multiplicity of individual or separate locking pins arranged in one or more rows which engage with an adjacent row of tumbler pins transverse to the longitudinal axis of the tumbler pins to retain the barrel in a locked position preventing rotational movement of the barrel relative to the lock body.

There is also provided retraction means on each tumbler pin on which allows retraction or inward movement of the locking pins from the locked position whereby the barrel may attain an unlocked position permitting rotation relative to the lock body.

The construction and arrangement of the cylinder lock assembly is such that when a key is inserted in the keyway the retraction means of each tumbler pin may be axially aligned to initiate the retraction or inward movement of the locking pins.

13 Claims, 10 Drawing Figures

CYLINDER LOCK EMBODYING AT LEAST TWO ROWS OF TUMBLER PIN BORES AND OPPOSED ROWS OF LOCKING PINS WHICH INTERACT TO PRECLUDE PICKING

This invention relates to an improved cylinder lock assembly.

Key actuated cylinder locks (also known as tumbler locks) are well known and generally comprise a plurality of spring biassed tumbler pins slidably located in a series of aligned parallel bores in a lock body. The pin bores are sealed at their outer ends to retain the biasing springs and at their inner ends the bores open into a cylindrical cavity. A rotatable key receiving barrel is located within the cylindrical cavity.

Hitherto such conventional cylinder locks have been easily forced open because the tumbler pins were usually of relatively small diameter and made from relatively soft metal such as brass. Because of these factors the tumbler pins were prone to being sheared upon forcing of the loçk by a tool such as a screw driver.

Also, if a key was inserted into a conventional cylinder lock and manipulated within the lock it was possible to open the lock in some circumstances. This usually occurred when a key was manufactured or obtained having notches or cuts which approximately corresponded to the notches or cuts provided in the correct key for a particular cylinder lock.

It was also the practice in some cases that in order to avoid a tight fit or a key binding in a particular lock that lock manufacturers marketed a key-lock combination having loose machining tolerances. As a consequence it was possible in some circumstances in order to gain unauthorized access to insert a loosely fitting key in a particular lock and manipulate the key within the lock to open same.

Australian Patent specification No. 82322/82 refers to a cylinder lock assembly comprising a generally cylindrical barrel body and a keyway formed in the barrel body and extending longitudinally inwardly from one end face. There is also provided a pair of opposed rows of guide bores extending outwardly from and communicating with the keyway. A set of locking pins is also provided wherein each locking pin is slidably received within an associated guide bore and retained therein so as to be movable from an operative position projecting into said keyway to a retracted position. To achieve this there is provided a pair of side bars having locking projections extending outwardly therefrom which may engage in an associated slot in the cylindrical barrel body. The locking projections of a side bar may engage in retaining apertures located in each locking pin located in an adjacent row thereof when in the operative position and may be disengaged therefrom when the locking pins are in the retracted position wherein the barrel body is locked in a barrel housing.

With the adoption of a pair of side bars and two rows of guide bores as described above this means that the cylinder lock arrangement of Specification No. 82322/82 is essentially restricted to use with a key having two key blades. Reference is made in Specification No. 82322/82 to the fact that a key could be utilized having two or more key blades and thus the number of rows of locking pins could be increased. However no description is given as to how this may be achieved and it is not seen by those skilled in the art how the number of rows of locking pins could be increased having regard to the fact that use is only made of a pair of side bars as referred to above.

It also must be borne in mind that use of a pair of side bars means of course that the lock still may be picked because only one movement is needed to dislodge a side bar with its integral locking projections from engagement with the locking pins in an adjacent row.

It also has been found that the lock assembly of Patent Specification No. 82322/82 in being restricted to the use of a pair of side bars and a pair of rows of locking pins was not versatile in operation and was restricted to a use of a key having two blades.

It therefore is an object of the invention to provide a cylinder lock assembly that alleviates the above-mentioned disadvantages associated with the prior art.

Accordingly the invention provides a cylinder lock assembly including:

a hollow lock body;

a barrel rotatably mounted in the lock body having a keyway extending longitudinally from one end thereof;

a plurality of tumbler pin bores located in one or more rows wherein each tumbler pin bore communicates with said keyway;

a plurality of tumbler pins provided in one or more rows wherein each tumbler pin is located in an associated tumbler pin bore;

a multiplicity of individual or separate locking pins arranged in one or more rows which engage with an adjacent row of tumbler pins transverse to the longitudinal axes of said tumbler pins to retain the barrel in a locked position preventing rotational movement relative to the lock body; and retraction means on each tumbler pin to allow retraction or inward movement of the locking pin from said locked position whereby the barrel may attain an unlocked position permitting rotation relative to the lock body;

the construction and arrangement being that when a key is inserted in the keyway the retraction means of each tumbler pin may be axially aligned to initiate said retraction or inward movement of the locking pins.

Preferably there is provided a plurality of rows of tumbler pin bores and corresponding rows of tumbler pins in the barrel with one row being staggered or offset relative to an adjacent row. The retraction means on each tumbler pin may also be axially offset or staggered. Preferably the retraction means on each tumbler pin is a waisted or reduced portion located intermediate the height thereof.

In the abovedescribed embodiment the actuating key may include a shank having spaced blades portions providing a number of rows of spaced notches which correspond to the number of rows of tumbler pin bores.

Preferably the locking pins are arranged in two or more rows. The locking pins may be spring biassed outwardly and engage with an adjacent row of tumbler pins in the engaged or locked position. Preferably the tumbler pins are spring biassed inwardly.

Suitably the or each row of locking pins is locatable in an associated locating groove in the lock body and in the locked position each row of locking pins may engage in their respective locating groove and also with an adjacent row of tumbler pins. Upon insertion of the key the locking pins may be released from engagement with their respective locating groove and retract into the barrel. For this purpose the barrel may be provided with locking pin bores preferably arranged in one or more rows corresponding to the number of rows of locking pins. Suitably each locking pin bore communicates with an adjacent tumbler pin bore.

The lock body may have any suitable shape. However, it is preferably cylindrical.

Reference may now be made to a preferred embodiment of the invention as shown in the attached drawings wherein.

Figure 1:
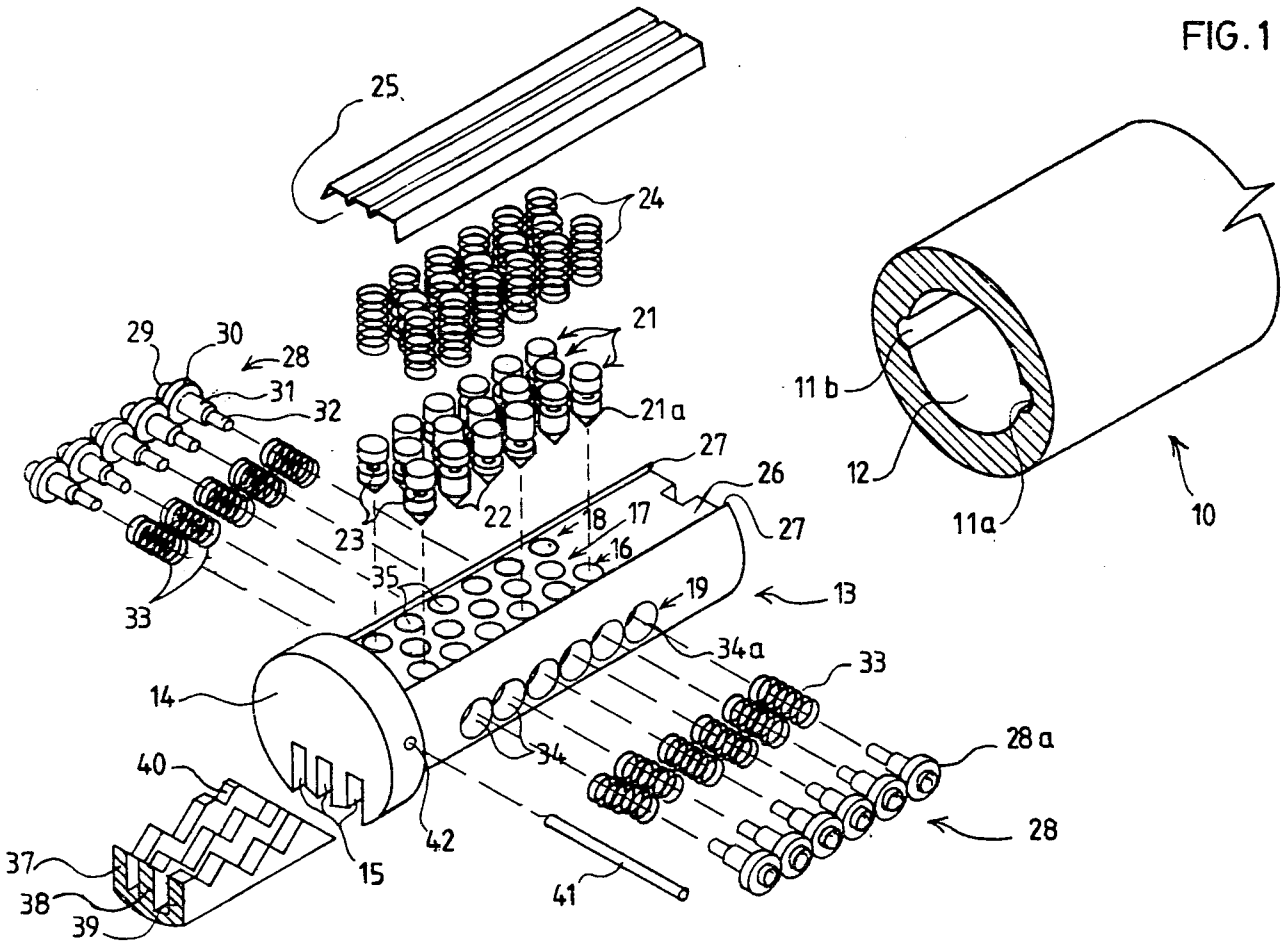
FIG. 1 is an exploded view of a cylinder lock constructed in accordance with the invention.

In the drawings there is shown a cylinder lock assembly including a lock body 10 having opposed grooves 11 in the internal bore 12 thereof. There is also shown barrel or plug 13 having an end flange 14 and a keyway including three key blade passages 15. Barrel 13 also has three rows of tumbler pin bores 16, 17 and 18 as shown. Rows 16 and 18 are in registry and intermediate row 17 is offset as shown. There is also shown opposed rows 19 of locking pin bores in opposed sides of the barrel 13.

There is also shown tumbler pins 21 having pointed or conical ends 22 and reduced portions 23. It will be noted that the reduced portion 23 are of different heights above pointed ends 22 with regard to progression along each row 16, 17 or 18.

Each tumbler pin 21 is engaged by a spring 24 biasing each pin in an inward direction as shown or towards the locked position.

There is also shown a shim 25 which engages in recess 26 of barrel 13. Recess 26 has opposed flanges 27.

Figure 4:
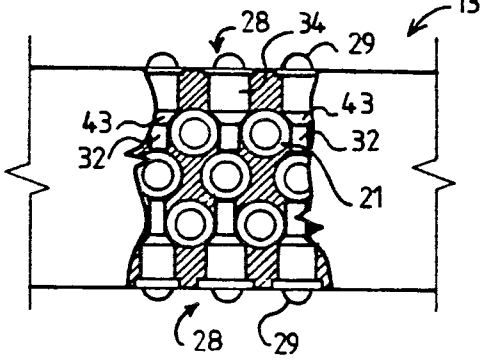
FIG. 4 is a part sectional side view of the cylinder lock of FIG. 1 in the locked position.
Figure 5:
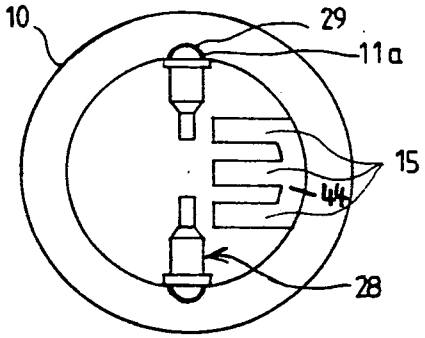
FIG. 5 is an end view of the cylinder lock of FIG. 4.
Figure 2:
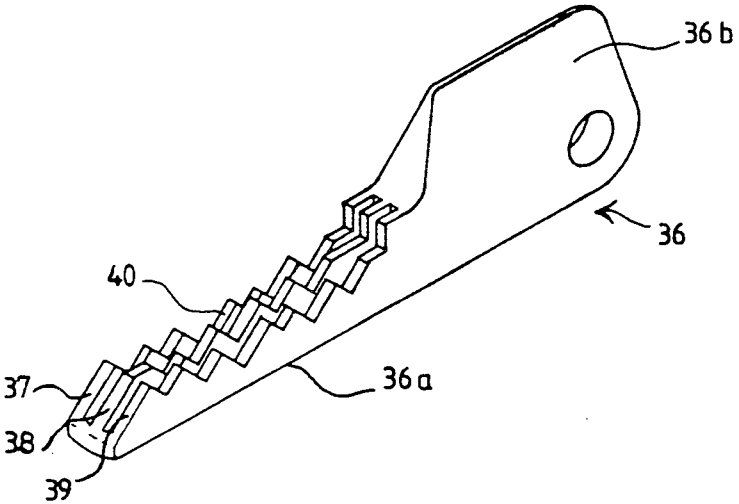
FIG. 2 is a perspective view of a suitable actuating key for insertion in the lock shown in FIG. 1.
Figure 6:
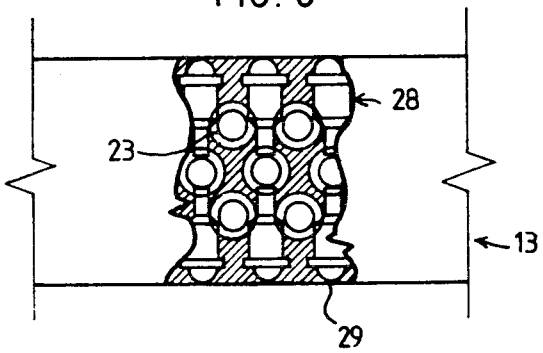
FIG. 6 is a part sectional side view of the cylinder lock of FIG. 1 in the open position.
Figure 7:
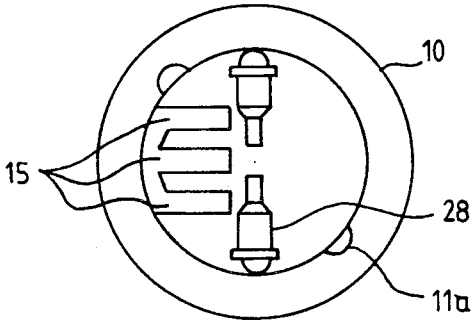
FIG. 7 is an end view of the cylinder lock of FIG. 6.

At opposed sides of barrel 13 are located locking pins 28 having base portion or dome 29, enlarged portion 30, body portion 31 and foot 32. Each locking pin 28 is biassed outwardly by springs 33, and engage in grooves 11*a* and 11*b* of lock body 10 in the locked position. Locking pins 28 engage in bores 34 located in each opposed side of barrel 13. Bores 34 communicate with tumbler pin bores 35 as shown in FIGS. 4 and 6.

There is also shown actuating key 36 having shank 36A, handle 36B and three spaced rows 37, 38 and 39 of notches 40 which are all of different heights and offset to each other as shown.

There is also shown hardened pin 41 engageable in socket 42 to prevent drilling of the lock to gain access to locking pins 28.

In operation of the lock assembly in the locked position each locking pin 28 has base portion 29 engageable in grooves 11. Portion 30 and body portion 31 and foot 32 engage in bores 34 as shown in FIG. 4. Thus, barrel 13 cannot rotate relative to lock body 10 in the locked position. In the locked position springs 33 maintain pins 28 in their retaining grooves 11.

When a key is inserted into the lock through apertures 15 notches 40 of rows 37, 38 and 39 engage with the pointed or conical ends 22 of pins 31 located in each row 16, 17 and 18. When the key is turned the locking pins 28 react against the grooves 11 and thereby are retracted within their associated bores 34.

In the locked position as shown in FIG. 4 each foot 32 of pins 28 and tapered part 43 engage a pair of adjacent tumbler pins 21 and a lower tumbler pin 21 in row 17 to provide three positions of mutual engagement for each locking pin 28. In the open position shown in FIG. 6 each locking pin engages with reduced portions 23 as shown allowing locking pins 28 to be retracted below the outer surface of barrel 13.

Figure 3:
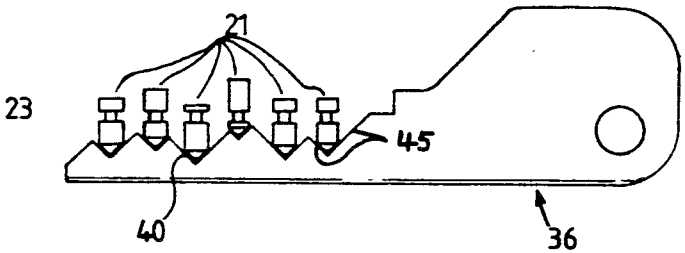
FIG. 3 is a side view of the key in FIG. 2 engaging a row of tumbler pins.

Each reduced portion 23 of tumbler pins 21 must all be in axial alignment as shown in FIG. 3 before barrel 13 may rotate to allow pins 28 to engage with reduced portions 23 of pins 21.

It will also be appreciated that lock body 10 may form part of any conventional lock such as a padlock, cylinder lock or cam lock. Thus, the invention in another aspect may include the actuating key per se as well as the barrel per se.

Figure 8:
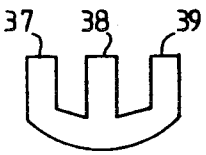
FIGS. 8, 9 and 10 illustrate differing cross-sectional profiles of a key constructed in accordance with the invention.
Figure 9:
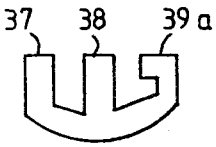
Figure 10:
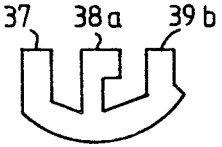

In another variation it will also be appreciated that the shank of key 36 insofar as shank portions 37, 38 and 39 are concerned may have a variety of different profiles or cross sectional shapes, such as those shown in FIGS. 8, 9 and 10 which may engage with correspondingly shaped blade passages 15 or barrel 13. Thus, FIG. 8 represents a profile for use in the assembly shown in FIG. 1. However, FIGS. 9 and 10 show shank portions 39A, 38A and 39B of different shape. This will enable a plurality of different keys to be used with the same barrel 13 and thus provides greater control over the handling and selling of suitable keys which are appropriate for the same type of lock which is constructed in accordance with the invention.

In the illustrated embodiment it will be appreciated that for 10 locking pins and three rows of tumbler bores that there are 30 different locking points bearing in mind that one locking pin has three locking points as discussed previously.

It will also be appreciated that the lock body 10 may have more than two opposed grooves 11*a* and 11*b* as shown. Thus, there may be provided 4, 6 or even 8 grooves in the periphery of lock body 10 with each groove being located directly opposite to another groove thereby providing additional withdrawal positions for key 36.

Thus, in this variation the barrel 13 may be turned to the 2, 4, 6 or 8 o'clock positions. The key may be taken out in any one of these positions and another key utilized as a master key to turn the barrel as desired. This feature may be appropriate for camlocks, timelocks, or electrical switchboards. It also would enable a security guard armed with the proper key to gain access to a special area of a building with the remainder of the building still being locked.

The drawings also show locking pin 28A engageable in bore 34A and also engageable with an adjacent tumbler pin 21A. The key in such circumstances cannot be withdrawn until the barrel has been rotated through 360°.

One groove 11*a* longer than the other and thus pin 28A engages with a corresponding notch in key 36 when the key is inserted into the barrel. Pin 28A in this case also engages a non-grooved internal surface of bore 12 upon rotation of the key. Thus the barrel 13 must be rotated through 360° until pin 28A can re-engage groove 11*a* and thus permit withdrawal of the key.

It will be appreciated from the foregoing that the lock of the invention provides substantial advantages over the prior art in dispensing with tumbler pin followers and also with top chambers where "masterpins" may still be engageable therewith.

In the illustrated embodiment each pin 28 has to slide at right angles between grooves or reduced portions 23 of adjoining tumbler pins 21 and engage in groove 23 of a third tumbler pin located immediately below it. The same occurs on the opposite side which means that five tumbler pins 21 need to be aligned for two locking pins 28 to function. A multiple effect is thereby created with 10 locking pins and thus it will be appreciated that lock picking or forcing will be substantially minimized or overcome.

It will also be appreciated that the arrangement of notches 40 in rows 37, 38 to 39 of key 36 may be varied together with corresponding changes in the tumbler pins 21 in a multiplicity of ways such as in number and pitch (i.e. the distance between adjacent notches) to provide a great number of locking permutations which is not possible with a conventional cylinder lock. Thus for example FIG. 1 showing 17 tumbler pins may provide a theoretical 16 billion different lock permutations.

It also will be appreciated that by the provision of separate locking pins as referred to above that lock picking or forcing is substantially overcome and that the invention provides a very versatile lock in practice.

Also shown is base passage 44 for blade passages 15 of the keyway. Each notch 40 of key 36 includes ramp faces 45 so as to facilitate each tumbler pin 21 to reach an axial alignment with regard to their respective wasted portions 23. It will be noted that key 36 has notches which are generally offset or staggered with respect to each other. This arrangement is possible because of the use of separate locking pins 28 in each row 19.

Thus from the foregoing it will be appreciated that the key of the invention may include at least two (and more preferably three) blades having notches which are staggered or offset relative to each other. This clearly distinguishes the invention from Patent specification No. 82322/82 wherein it is essential that the two blades have parallel ramp faces of corresponding notches although each notch may have different heights.

Although the present invention has been described in some detail by way of illustration and example for purposes of clarity of understanding, it will of course be understood that various changes and modifications may be made in the form, details, and arrangements of the parts without departing from the scope of the invention as set forth in the following claims.

I claim:

1. A cylinder lock assembly comprising:

a hollow lock body;

a barrel rotatably mounted in the lock body having a keyway extending longitudinally from one end thereof;

a plurality of tumbler pin bores located in said barrel provided in at least two rows wherein each tumbler pin bore communicates with said keyway;

a plurality of tumbler pins wherein each tumbler pin is located in an associated tumbler pin bore;

a multiplicity of locking pin bores located in said barrel in at least two rows wherein each locking pin bore is oriented normal to an adjacent pair of tumbler pin bores contained in an adjoining row and is interposed therebetween;

a multiplicity of locking pins and each said locking pin being located in an associated locking pin bore so that in a locked position each said locking pin engages with an adjacent pair of tumbler pins on opposed sides thereof to thereby prevent rotational movement of the barrel relative to the lock body; and withdrawal means on each locking pin so as to enable retraction of the locking pins from engagement with the lock body, thereby allowing the barrel to attain an unlocked position permitting rotation relative to the lock body upon insertion of a key in said keyway.

2. A cylinder lock assembly as claimed in claim 1, wherein three rows of tumbler pin bores are provided so as to define two outer rows and an intermediate row and in the locked position each locking pin engages with a third tumbler pin in said intermediate row as well as said adjacent pair of tumbler pins.

3. A cylinder lock assembly as claimed in claim 1, wherein each locking pin is separate from each other so as to be independently movable.

4. A cylinder lock assembly as claimed in claim 2, wherein each tumbler pin includes a reduced portion intermediate its length.

5. A cylinder lock assembly as claimed in claim 1, wherein said withdrawal means of each locking pin includes a tapered portion intermediate its length.

6. A cylinder lock assembly as claimed in claim 4, wherein each locking pin includes a head portion, an enlarged portion, a body portion and a foot whereby in the locked position each head portion is engaged in an associated groove in said lock body; said enlarged portion abuts an internal side wall of the lock body; the body portion engages in an associated locking pin bore; the tapered portion engages with said pair of adjacent tumbler pins in an adjoining outer row of tumbler pin bores and the foot engages a lower tumbler pin in the intermediate row of tumbler pin bores and in the unlocked position each locking pin withdraws within its respective locking pin bore to be interposed between reduced portions of said pair of adjacent tumbler pins with said foot being located within the reduced portion of said lower tumbler pin.

7. A cylinder lock assembly as claimed in claim 2, wherein the barrel has three longitudinal rows of tumbler pin bores, thereby defining two outer rows in registry and an intermediate row which is offset relative to each outer row.

8. A cylinder lock assembly as claimed in claim 1, wherein each locking pin is resiliently biased away from the locked position.

9. A cylinder lock assembly as claimed in claim 1, wherein said lock body includes tow or more spaced grooves, and wherein each groove corresponds to an adjacent row of locking pin bores.

10. A cylinder lock assembly as claimed in claim 1, wherein each tumbler pin is biased toward the locked position.

11. A cylinder lock assembly as claimed in claim 2, wherein the keyway includes a base part and at least three passages and each passage is aligned with a respective row of tumbler pin bores.

12. A cylinder lock assembly comprising:

a hollow lock body;

a barrel rotatably mounted in said lock body having a keyway extending longitudinally from one end thereof;

a plurality of tumbler pin bores located in said barrel located in at least three rows wherein each tumbler pin bore communicates with said keyway;

a plurality of tumbler pins, each said tumbler pin being located in an associated tumbler pin bore;

a multiplicity of locking pin bores in said barrel in at least two rows and each said locking pin bore being oriented normal to an adjacent pair of tumbler pins and is interposed therebetween;

a multiplicity of locking pins and said locking pin being located in an associated tumbler pin bore, so that in a locked position each said locking pin engages with an adjacent pair of tumbler pins on opposed sides theereof and with a third tumbler pin at an inner end thereof to thereby prevent rotational movement of the barrel relative to said lock body; and withdrawal means on each locking pin so as to enable withdrawal of the locking pins from the locked position, whereby the barrle may attain an unlocked position permitting rotation relative to said lock body upon insertion of a key in said keyway.

13. A cylinder lock assembly as claimed in claim 12, wherein each locking pin is separate from each other so as to be independently movable.

* * * * *